US011786089B2

(12) United States Patent
Fauss et al.

(10) Patent No.: US 11,786,089 B2
(45) Date of Patent: Oct. 17, 2023

(54) VACUUM CLEANER INCLUDING HOSE RETAINER WITH DUSTPAN AND METHOD OF ASSEMBLING SAME

(71) Applicant: Emerson Electric Co., St. Louis, MO (US)

(72) Inventors: Taylor M. Fauss, Florissant, MO (US); Christopher Burch, St. Louis, MO (US); Timothy Richard Quagliata, Cottleville, MO (US)

(73) Assignee: Emerson Electric Co., St. Louis, MO (US)

( * ) Notice: Subject to any disclaimer, the term of this patent is extended or adjusted under 35 U.S.C. 154(b) by 2 days.

(21) Appl. No.: 17/575,440

(22) Filed: Jan. 13, 2022

(65) Prior Publication Data

US 2023/0218131 A1 Jul. 13, 2023

(51) Int. Cl.
*A47L 9/00* (2006.01)
*A47L 9/24* (2006.01)

(52) U.S. Cl.
CPC ..... *A47L 9/0036* (2013.01); *A47L 9/242* (2013.01)

(58) Field of Classification Search
CPC ..... A47L 1/00; A47L 3/00; A47L 4/00; A47L 5/00; A47L 7/00; A47L 9/00; A47L 11/00; A47L 13/00; A47L 15/00; A47L 17/00; A47L 19/00; A47L 21/00; A47L 23/00; A47L 25/00; A47L 2201/00; A47L 2301/00; A47L 2401/00; A47L 2501/00; A47L 2601/00; A47L 9/0036; A47L 9/242
See application file for complete search history.

(56) References Cited

U.S. PATENT DOCUMENTS 2,519,741 A 8/1950 Caughey
4,616,378 A 10/1986 Berfield et al.
5,437,078 A * 8/1995 Courcelles ..... A47L 13/52 15/328
6,230,361 B1 5/2001 Griffin
7,185,389 B2 3/2007 Thomason et al.
7,287,301 B2 10/2007 Marshall et al.
(Continued)

OTHER PUBLICATIONS

Rigid 3 Gallon Wet-Dry Vac Owner's Manual WD30500/WD3050MO, accessed Sep. 26, 2016, pp. 1-36.
(Continued)

*Primary Examiner* — Eric J Rosen
*Assistant Examiner* — Christopher Soto
(74) *Attorney, Agent, or Firm* — Armstrong Teasdale LLP

(57) ABSTRACT

A vacuum cleaner includes a canister defining a debris chamber, a powerhead connected to a top of the canister, a hose, and a hose retainer removably connected to the canister. The canister includes a base and at least one sidewall extending therefrom. The powerhead includes a suction unit operable to generate airflow through the canister. The hose retainer includes a back plate defining an aperture therethrough, at least one hose retention clip defining a channel shaped and sized to receive the hose therein, and a dustpan defining a debris intake opening and including a hose end mount. When an inlet end of the hose is connected to the hose end mount, the inlet end of the hose is connected in fluid communication with the debris intake opening to generate airflow therethrough.

19 Claims, 10 Drawing Sheets

(56) References Cited

U.S. PATENT DOCUMENTS

| | | | | |
|---|---|---|---|---|
| 7,877,839 | B2 * | 2/2011 | Phelan | A47L 7/0009 15/354 |
| D647,261 | S | 10/2011 | Schultz et al. | |
| 8,267,538 | B2 | 9/2012 | Lin | |
| 8,756,756 | B2 | 6/2014 | Theising et al. | |
| 8,938,849 | B2 | 1/2015 | Cleary | |
| 9,282,861 | B2 * | 3/2016 | Schultz | A47L 13/52 |
| 10,869,586 | B2 * | 12/2020 | Bearup | A47L 9/244 |
| 1,176,733 | A1 | 8/2021 | Yagur et al. | |

OTHER PUBLICATIONS

ATO Industrial Vacuum Cleaner, Wet and Dry, 3000W product page, 2021, pp. 1-9.

Dewalt 4 Gallon Poly Wet/Dry Vac, The Home Depot Product Webpage, pp. 1-14 retrieved from the Internet on Jan. 6, 2022 at https://www.homedepot.com/p/DEWALT-4-Gal-Poly-Wet-Dry-Vac-DXVO47/305323613.

Milwaukee M18 18-Volt 2 Gal. Lithium-Ion Cordless Wet/Dry Vacuum (Tool-Only), pp. 1-13 retrieved retrieved from the Internet on Jan. 6, 2022 at https://www.homedepot.com/p/Milwaukee-M-18-18-volt-2-Gal-Lithium-Ion-Cordless-West-Dry-Vacuum-Tool-Only-0880-20/202043806.

Ridgid 4.5 Gallon 5.0-Peak HP ProPack West/Dry Shop Vacuum with Fine Dust Filter, Expandable Hose and Accessories, pp. 1-9 retrieved from the Internet on Jan. 6, 2022 at https://www.homedepot.com/p/RIDGID-4-5-Gallong-5-0-Peak-Hp-PoPack-Wet-Dry-Shop-Vacuum-with-Fine-Dust-Filter-Expandable-House-and-Accessories-WD4522.

* cited by examiner

VACUUM CLEANER INCLUDING HOSE RETAINER WITH DUSTPAN AND METHOD OF ASSEMBLING SAME

FIELD OF THE DISCLOSURE

The field relates generally to vacuum cleaners and, in particular, to vacuum hose retainers for use with vacuum cleaners.

BACKGROUND

Wet/dry vacuum cleaners are useful tools for a variety of cleaning applications due to their high suction power and durable, high-capacity debris storage capability. Many such vacuums include a flexible hose that a user can manually operate to pick up debris. However, vacuum hoses can be bulky and difficult to store, increasing the amount of storage space required for the vacuum cleaner as a whole.

This section is intended to introduce the reader to various aspects of art that may be related to various aspects of the disclosure, which are described and/or claimed below. This discussion is believed to be helpful in providing the reader with background information to facilitate a better understanding of the various aspects of the present disclosure. Accordingly, it should be understood that these statements are to be read in this light, and not as admissions of prior art.

SUMMARY

In one aspect, a vacuum cleaner includes a canister, a powerhead connected to a top of the canister, a hose, and a hose retainer removably connected to the canister. The canister defines a debris chamber and includes a base and at least one sidewall. The sidewall extends from the base and includes an inlet port. The powerhead includes a suction unit operable to generate airflow through the canister. The hose has a first, inlet end and a second, outlet end removably connectable to the inlet port. The hose includes a back plate defining an aperture therethrough, at least one hose retention clip defining a channel shaped and sized to receive a portion of the hose therein, and a dustpan defining a debris intake opening. The dustpan further includes a hose end mount removably connectable to the inlet end of the hose. When connected to the hose end mount, the inlet end of the hose is in fluid communication with the debris intake opening to generate airflow through the debris intake opening.

In another aspect, a hose retainer for a vacuum cleaner includes a back plate defining an aperture therethrough, at least one hose retention clip, and a dustpan. The at least one hose retention clip defines a channel sized and shaped to receive a portion of a vacuum hose therein. The dustpan defines a debris intake opening and includes a hose end mount. The hose end mount defines an opening sized and shaped to receive an end of the hose therein.

In yet another aspect, a method of assembling a vacuum cleaner includes connecting a hose retainer to a sidewall of a canister, connecting a powerhead to a top of the canister, connecting an inlet end of a hose to a dustpan of the hose retainer, connecting an outlet end of the hose to an inlet port of the canister, and disposing a portion of the hose within at least one hose retention clip of the hose retainer.

Various refinements exist of the features noted in relation to the above-mentioned aspects of the present disclosure. Further features may also be incorporated in the above-mentioned aspects of the present disclosure as well. These refinements and additional features may exist individually or in any combination. For instance, various features discussed below in relation to any of the illustrated embodiments of the present disclosure may be incorporated into any of the above-described aspects of the present disclosure, alone or in any combination.

BRIEF DESCRIPTION OF THE DRAWINGS

Corresponding reference characters indicate corresponding parts throughout the drawings.

DETAILED DESCRIPTION

Figure 1:
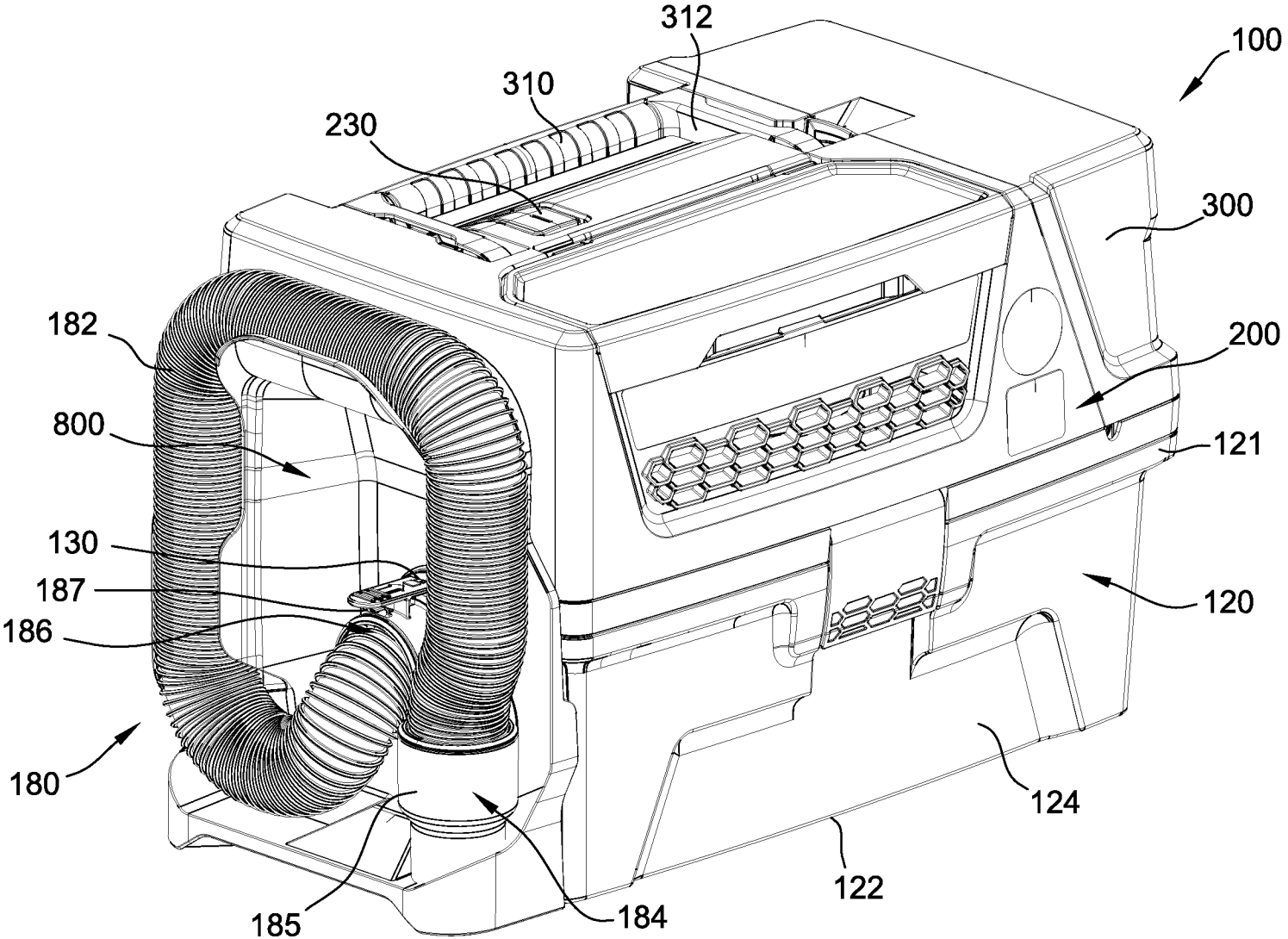
FIG. 1 is a perspective view of a vacuum cleaner including a canister, a powerhead, a hose retainer, and a vacuum conduit.
Figure 2:
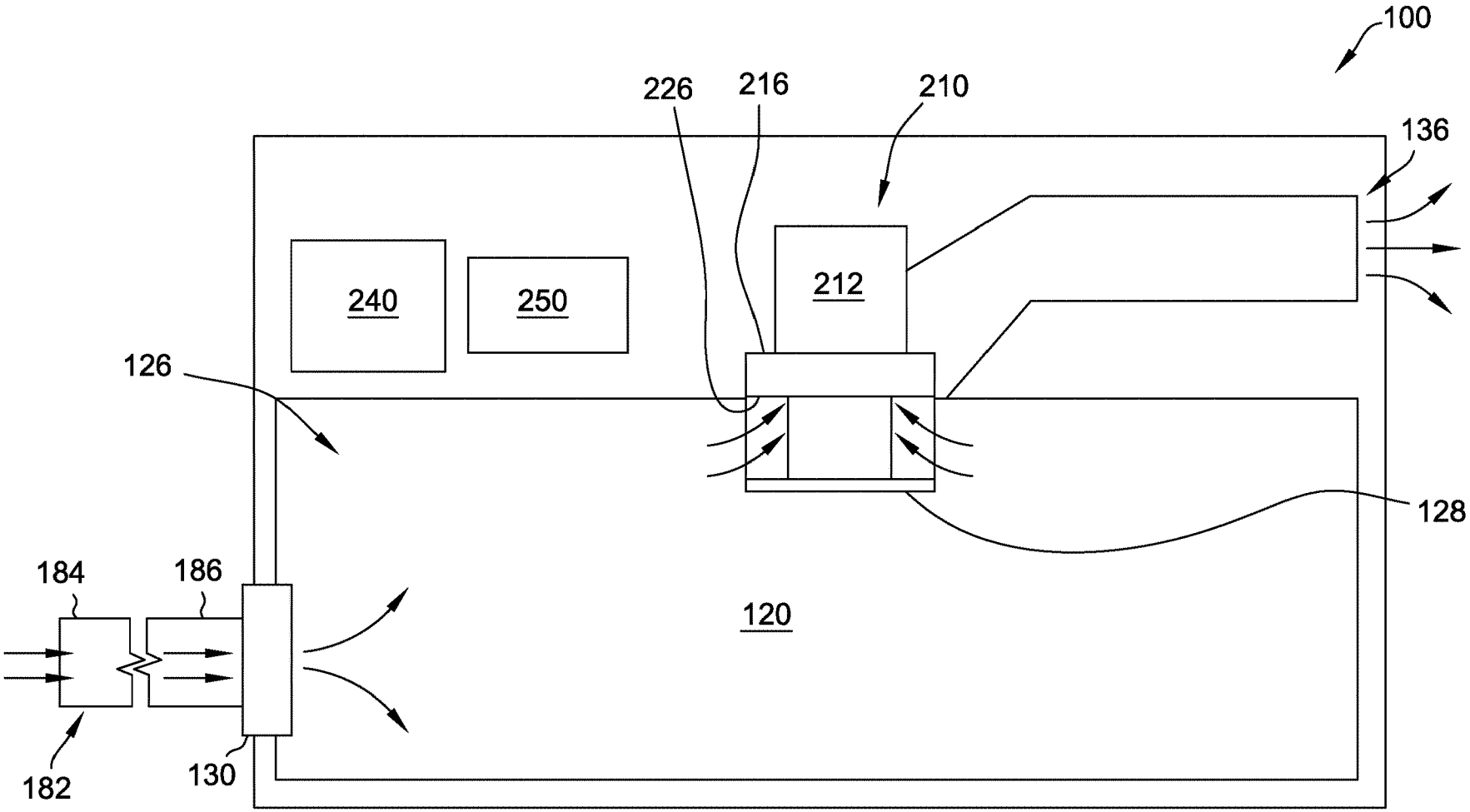
FIG. 2 is a schematic view of the vacuum cleaner shown in FIG. 1.

FIG. 1 is a perspective view of an example vacuum cleaner 100, illustrated in the form of a portable wet/dry vacuum cleaner. FIG. 2 is schematic view of the vacuum cleaner 100 shown in FIG. 1. Although the vacuum cleaner 100 is shown and described herein with reference to a wet/dry vacuum cleaner, vacuum cleaners consistent with this disclosure may be embodied in other types and in other combinations, including, for example and without limitation, upright vacuum cleaners, backpack vacuum cleaners, and canister vacuum cleaners.

In the illustrated embodiment, the vacuum cleaner 100 includes a collection drum or canister 120 including an inlet port 130, and a powerhead 200 removably mounted to a top 121 of the canister 120. The canister 120 defines a debris chamber 126 (FIG. 2) for storing debris collected by the vacuum cleaner 100. The powerhead 200 is removably attached to the canister 120 (e.g., via a hinge mechanism or latches) such that it can be readily removed to empty debris or liquids contained in the canister 120. The powerhead 200 includes a housing 300 and, as shown in FIG. 2, a motor 212 and a suction device 216 (collectively referred to as a suction unit 210) located within the housing 300. The suction unit 210 is operable to generate airflow through the debris chamber 126 from an inlet opening 132 defined by the inlet port 130 to an outlet port 136 such that debris and/or liquid is drawn into the debris chamber 126.

A vacuum conduit 180 is removably connected to the inlet port 130 to direct suction and/or forced air generated by the suction unit 210 into the debris chamber 126. The vacuum cleaner 100 also includes a hose retainer 800 removably connected to the canister 120 that includes structure for storing the vacuum conduit 180 and using the vacuum conduit 180 in multiple configurations.

Figure 3:
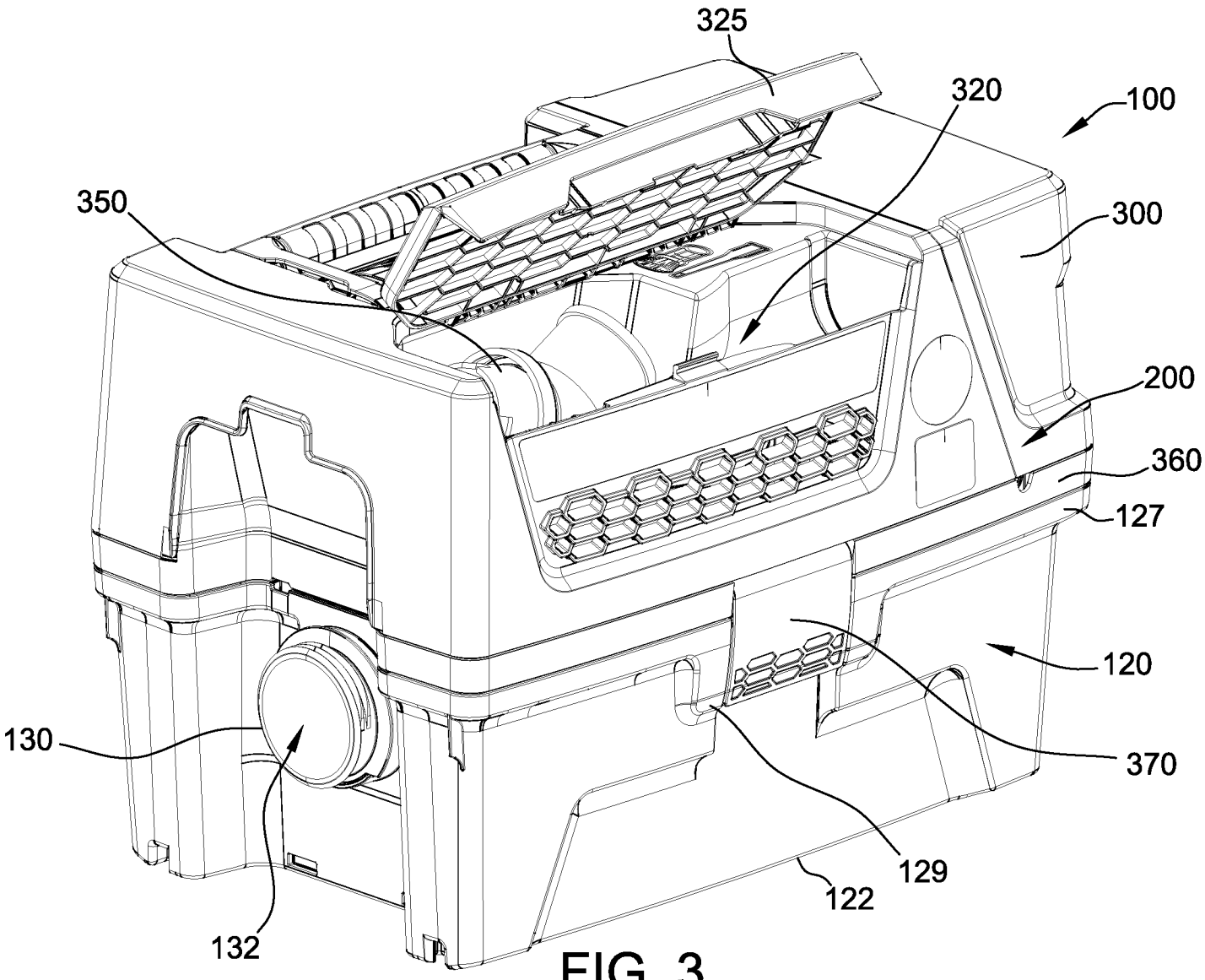
FIG. 3 is a perspective view of the vacuum cleaner shown in FIG. 1, with the hose retainer and the vacuum conduit removed.

With reference to FIGS. 1 and 3, the canister includes a base 122 and at least one sidewall 124 extending upward from the base 122. In the illustrated embodiment, the inlet port 130 is defined by the sidewall 124 of the canister 120, and the outlet port 136 is defined by the powerhead 200. In other embodiments, the inlet port 130 and outlet port 136 may be included in any suitable portion of the vacuum cleaner 100 that enables the vacuum cleaner 100 to function as described herein. The debris chamber 126 is fluidly connected to both the inlet port 130 and the outlet port 136. The canister 120 can further include an access door or lid (not shown) that provides access to the debris chamber 126, for example, to empty debris collected within the debris chamber 126.

The powerhead housing 300 includes a rim 360 that engages an upper rim 127 of the canister 120 (e.g., to form a seal between the powerhead 200 and the canister 120). The vacuum cleaner 100 can include a latching mechanism for securing the housing 300 to the canister 120. As shown in FIG. 3, the latching mechanism can include one or more latches 370 disposed proximate the rim 360 of the housing 300 and one or more catches 129 disposed proximate the upper rim 127 of the canister 120. Each pair of catches 129 and latches 370 are shaped, sized, and positioned to interlock, thereby detachably securing the powerhead 200 to the canister 120.

The powerhead 200 also includes a handle 310 to facilitate lifting, manipulating, and/or transporting the vacuum cleaner 100. The handle 310 can be formed integrally with the powerhead housing 300, or it can be formed separately from and attached to the housing 300 or another part of the powerhead 200. In the illustrated embodiment, the handle 310 is hingedly connected to the housing 300 and is selectively rotatable from a flat, stowed position, in which the handle 310 is substantially flush or conformal with the powerhead housing 300, to an upward, deployed position, in which the handle 310 extends upwardly from the housing 300 via one or more support arms 312. The vacuum cleaner 100 can also be transported by rolling it on optional wheels or casters (not shown) removably connected to the canister 120. The housing 300 can define one or more storage cavities or recesses 320 (FIG. 3) sized and shaped to receive a vacuum accessory 350 therein. The storage recess 320 can include a storage recess lid 325 hingedly connected to the housing 300 to selectively enclose the storage recess 320.

Figure 5:
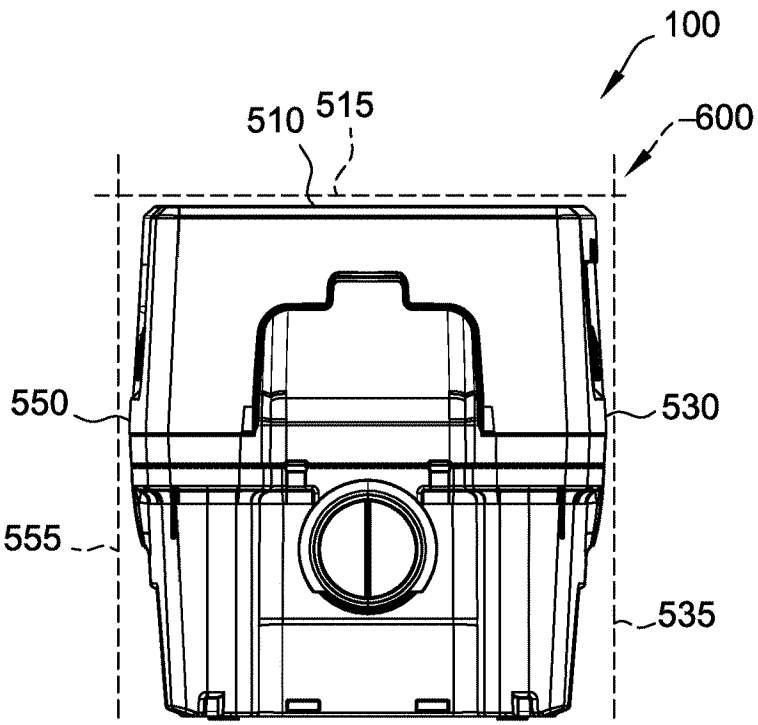
FIG. 5 is a side view of the vacuum cleaner shown in FIG. 1, with the hose retainer and the vacuum conduit removed.
Figure 4:
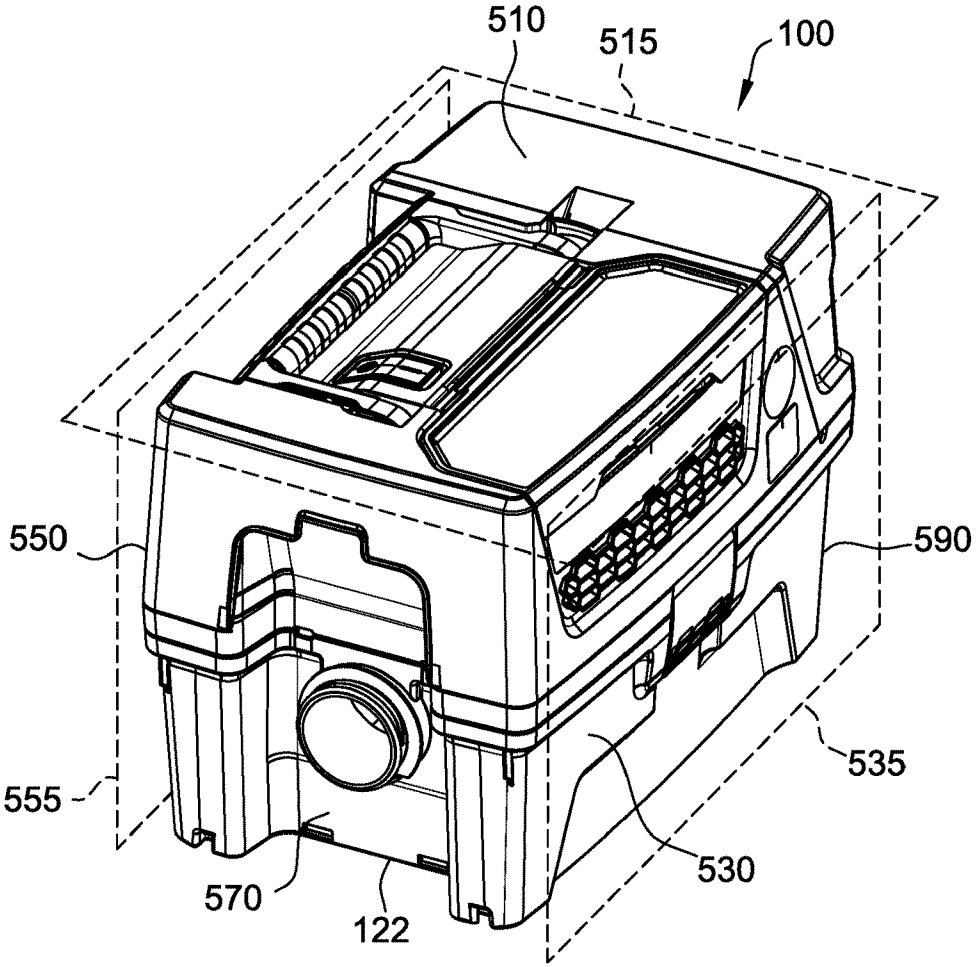
FIG. 4 is another perspective view of the vacuum cleaner shown in FIG. 1, with the hose retainer and the vacuum conduit removed.

With reference to FIGS. 4 and 5, the vacuum cleaner 100 includes a top surface 510 defining a top plane 515, which opposes and is generally parallel to the base 122 of the canister 120. The vacuum cleaner 100 also includes a front surface 530 defining a front plane 535 and an opposite, generally parallel rear surface 550 defining a rear plane 555. The vacuum cleaner 100 further includes a first, inlet side surface 570 and an opposite and generally parallel second, outlet side surface 590. The front surface 530, rear surface 550, inlet side surface 570, and outlet side surface 590 are all generally perpendicular to the top surface 510 and to the base 122 of the canister 120. All surfaces of the vacuum cleaner 100 are generally rectangular in shape, but they can also be any other suitable shape, for example and without limitation, round, square, or ovoid. When viewed from the inlet side surface 570, as in FIG. 5, or from the outlet side surface 590, the vacuum cleaner 100 has a side profile 600 defined by the top surface 510, the front surface 530, and the rear surface 550. The side profile 600 of the illustrated embodiment is rectangular, but may have any other suitable shape, for example and without limitation, round, square, or ovoid.

The vacuum conduit 180 can generally include any suitable conduit for directing suction and/or forced air, including, for example and without limitation, vacuum hoses, vacuum wands or tubes, surface cleaning tools, and combinations thereof. With reference to FIG. 1, the vacuum conduit 180 includes a hose 182 having a first, inlet end 184 and a second, outlet end 186. In the illustrated embodiment, an outlet adapter 187 is connected to the outlet end 186 of the hose 182 to removably connect the outlet end 186 of the hose 182 to the inlet port 130 of the canister 120. An inlet adapter 185 is connected to the inlet end 184 of the hose 182, which will be discussed in greater detail further below.

With reference to FIG. 2, the suction unit 210 includes a motor 212 operatively connected to a suction device 216 to generate airflow through the debris chamber 126. The suction device 216 receives airflow from the debris chamber through a suction inlet 226 defined at the bottom of powerhead 200. The suction inlet 226 is fluidly connected to the outlet port 136 of the canister 120. The suction device 216 can include, for example and without limitation, an impeller, a fan, or any suitable device for generating a sufficient suction force for collecting dirt, debris, and other wet and/or dry materials within the debris chamber 126.

The vacuum cleaner 100 can also include a filter assembly 128 operable to filter out fine debris and small particles from the airflow through the debris chamber 126. In the illustrated embodiment, the filter assembly 128 is connected to and depends downward from the powerhead 200 and into the debris chamber 126. The illustrated filter assembly 128 is a cartridge filter, but the vacuum cleaner 100 can also operate with other types of filters, including, for example and without limitation, a bag filter.

In operation, when the motor 212 is energized, air flows into the canister 120 through the inlet port 130, through the filter assembly 128, and into the powerhead 200 through the suction inlet 226, before being exhausted back into an environment surrounding the vacuum cleaner 100 through the outlet port 136.

Operation of the suction unit 210 creates an airflow path between the inlet end 184 of the hose 182 and the outlet port 136 of the powerhead 200. The airflow path is illustrated generally by the arrows in FIG. 2. The suction unit 210 creates a suction force at the inlet end 184 of the hose 182, drawing airflow and debris through the hose 182 from the inlet end 184 to the outlet end 186, through the inlet port 130 of the canister 120 and into the debris chamber 126, through the filter assembly 128, and through the suction device 216 and out the outlet port 136 into an environment surrounding the vacuum cleaner 100. A user can thus operate the vacuum cleaner 100 by moving the inlet end 184 of the hose 182 over surfaces to be cleaned or debris to be picked up. In certain embodiments, a vacuum accessory can be attached to the inlet end 184 of the hose 182, including, for example and without limitation, an extension wand, a dusting brush, a nozzle, a crevice tool, or a rotary brush. In certain embodiments, operation of the suction unit 210 can be reversed to enable the vacuum cleaner 100 to operate as a blower. In such embodiments, the suction unit 210 generates airflow through the debris chamber 126 from the outlet port 136 to the inlet port 130, and through the hose 182 from the outlet end 186 and out the inlet end.

The powerhead 200 can also include a controller 250 and a power switch 230 for selectively connecting and disconnecting the vacuum cleaner 100 from a power source 240. The power source 240 can be any suitable power source that supplies electrical power to components of the vacuum cleaner 100, such as the motor 212 and the controller 250, and that enables the vacuum cleaner 100 to operate as described herein. Suitable types of power sources include, for example and without limitation, DC power sources, such as battery packs, and AC power sources, such as mains AC electricity from a household or commercial wall outlet.

In the illustrated embodiment, the power source 240 is an on-board battery or battery pack. The vacuum cleaner 100 can be used with a power cord (not shown) to supply AC power to other components or to convert the supplied power to DC power to charge the battery. In such embodiments, the vacuum cleaner 100 can be selectively operated in a cordless mode, in which the power source 240 is electrically connected to the vacuum cleaner 100, and a corded mode, in which the power cord is electrically connected to the vacuum cleaner and supplies AC power to the vacuum cleaner 100 (e.g., from a wall outlet). Other embodiments can be operated only from a battery or only from AC power.

In other embodiments, the vacuum cleaner 100 does not have an on-board battery, and the power source 240 is an AC power source provided by a wall outlet. In such embodiments, the vacuum cleaner 100 includes a power cord (not shown) for electrical connection to the wall outlet (e.g., via an extension cord) to supply power to the vacuum cleaner 100. The power cord can be wrapped around optional cord locks (not shown) connected to the vacuum cleaner 100 for storage purposes.

Figure 6:
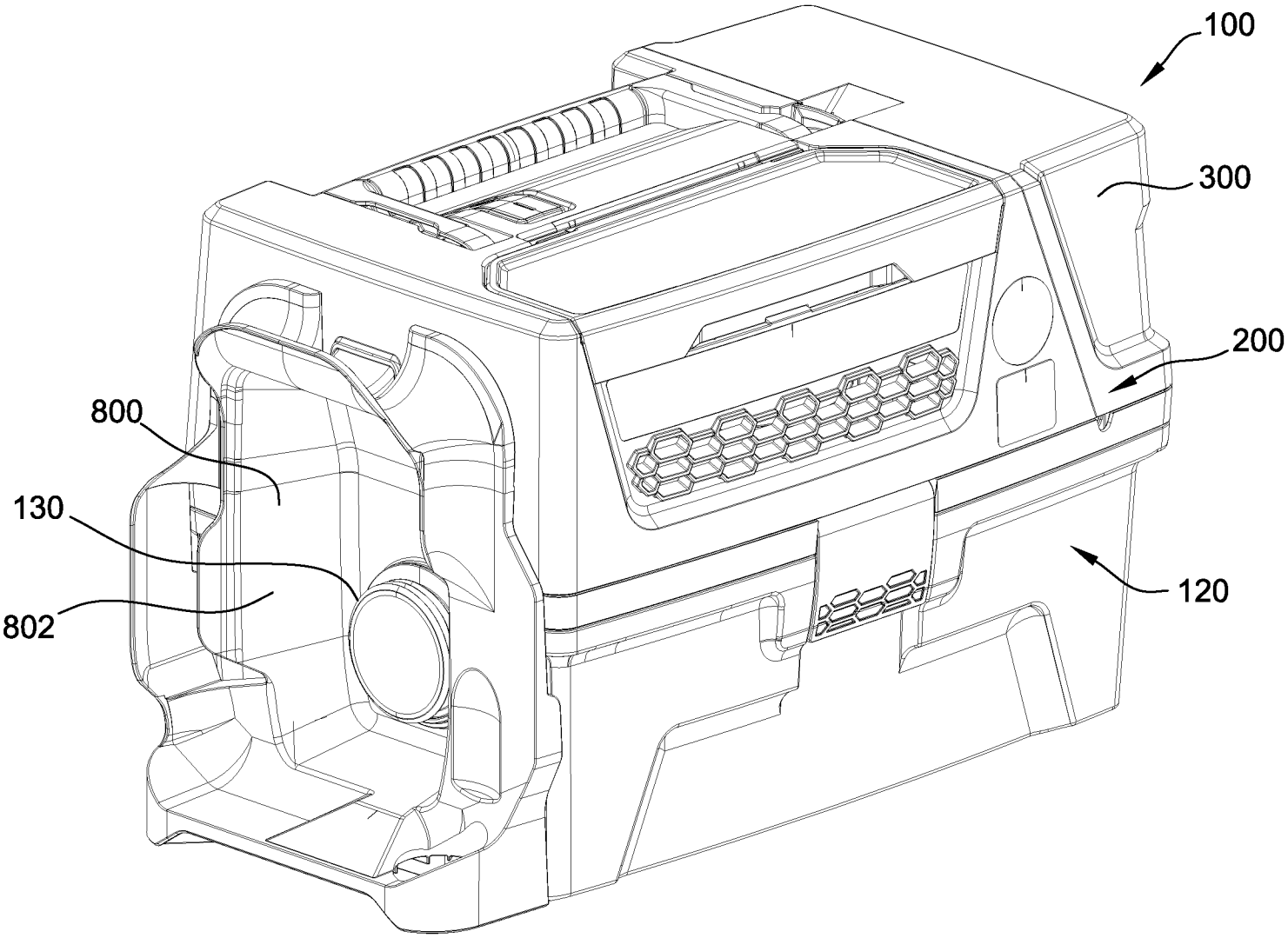
FIG. 6 is a perspective view of the vacuum cleaner shown in FIG. 1, with the vacuum conduit removed.

With reference to FIG. 6, the hose retainer 800 is connected to the vacuum cleaner 100, and is configured to retain the vacuum conduit 180 (not shown in FIG. 6) therein. As described in further detail herein, the hose retainer 800 is configured to function as a dustpan, utilizing the vacuum conduit 180 as a suction source to remove debris swept into the dustpan.

Figure 7:
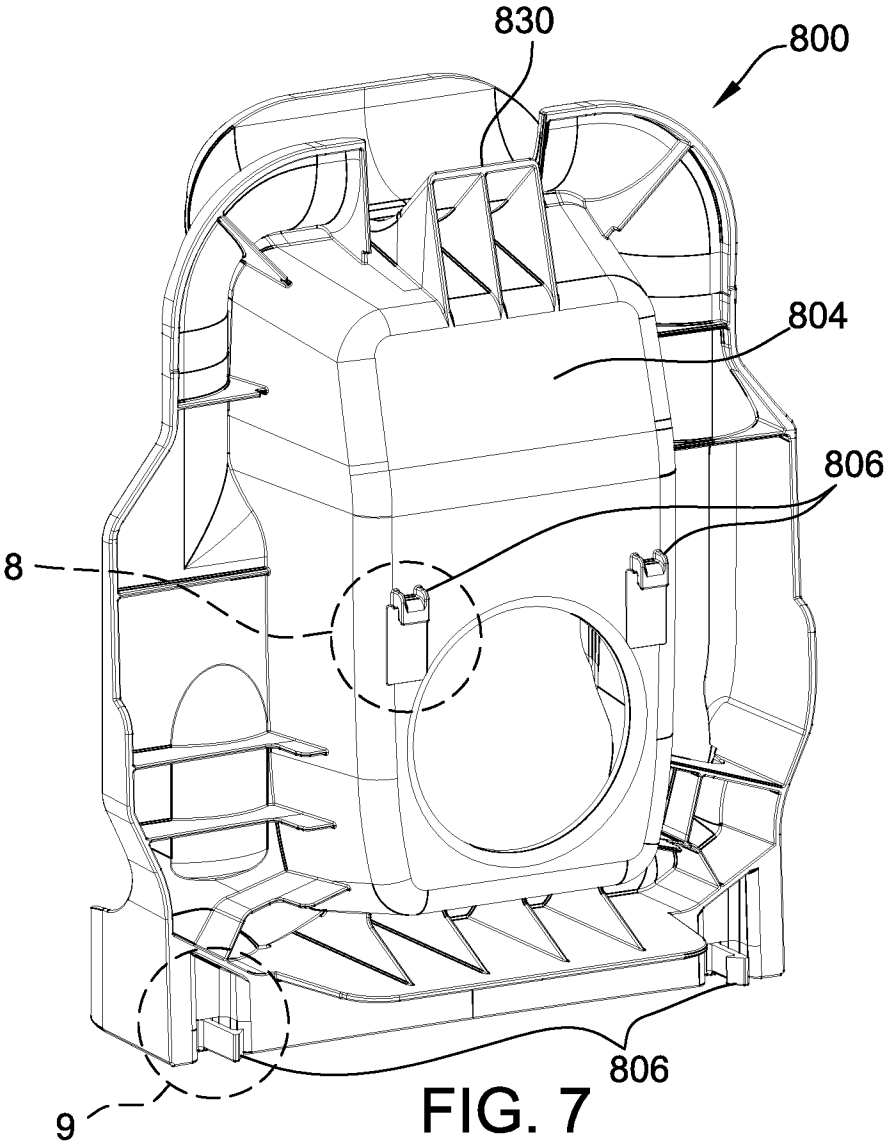
FIG. 7 is a perspective view of an inward-facing side of the hose retainer of the vacuum cleaner shown in FIG. 1

The hose retainer 800 is removably connected to the vacuum cleaner 100, specifically to the canister 120 in the illustrated embodiment. The hose retainer 800 of the example embodiment is connected or fastened only to the canister 120 such that the powerhead 200 can be removed from canister 120 without first removing the hose retainer 800. With additional reference to FIG. 7, the hose retainer 800 includes a first, outward-facing side 802 and a second, inward-facing side 804 (FIG. 7). When the hose retainer 800 is installed on the vacuum cleaner 100 as shown in FIG. 6, the inward-facing side 804 is in face-to-face engagement with the canister 120 (specifically, the canister sidewall 124 along the inlet side surface 570) and the powerhead 200. The hose retainer 800 can include one or more fasteners 806 (e.g., disposed on the inward-facing side 804) for removably connecting the hose retainer 800 to the canister 120. The canister 120 can include one or more corresponding fastener slots or recesses for receiving the fasteners. Suitable fasteners include, for example and without limitation, hooks, tabs, pins, and combinations thereof.

Figure 8:
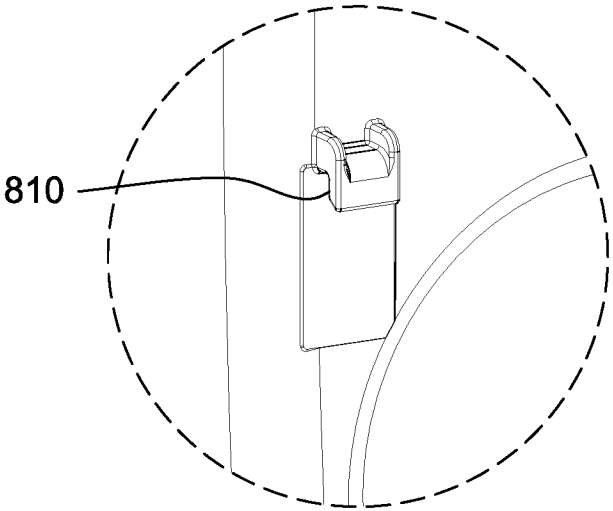
FIG. 8 is an enlarged view of a portion of the inward-facing side of the hose retainer shown in FIG. 7.
Figure 9:
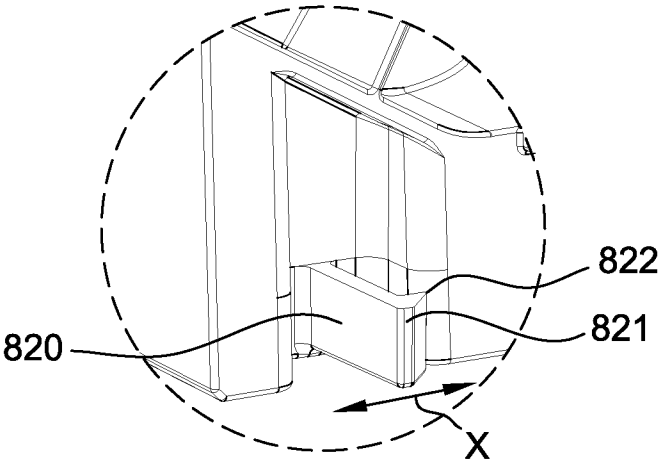
FIG. 9 is an enlarged view of another portion of the inward-facing side of the hose retainer shown in FIG. 7.
Figure 11:
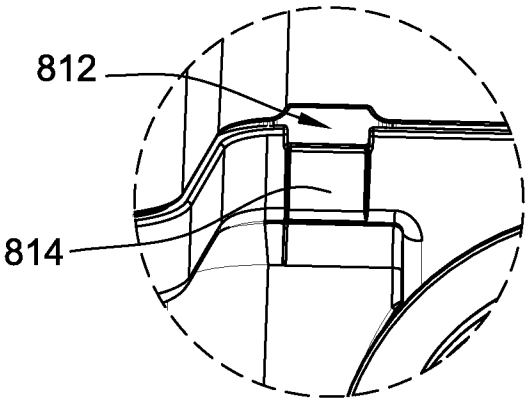
FIG. 11 is an enlarged view of a portion of the vacuum cleaner shown in FIG. 10.
Figure 10:
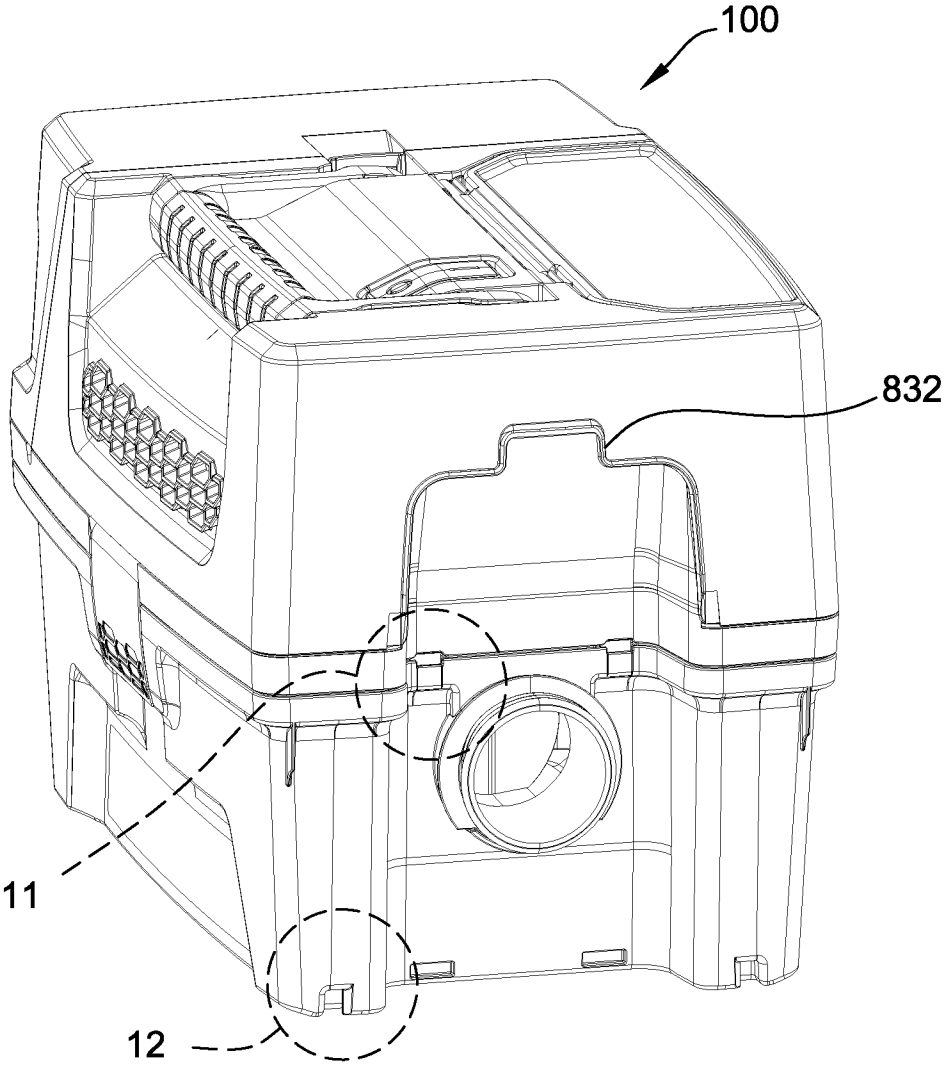
FIG. 10 is a perspective view of the vacuum cleaner shown in FIG. 1 with the hose retainer and the vacuum conduit removed.

With additional reference to FIGS. 8 and 9, the illustrated hose retainer 800 includes two sets of fasteners 806, illustrated in the form of hooks 810 (FIG. 8) and deflectable tabs 820 (FIG. 9). The hose retainer 800 includes two hooks 810 and two tabs 820 in the illustrated embodiment, although the hose retainer 800 can include any suitable number of hooks 810 and/or tabs 820 that enable the hose retainer 800 to function as described herein. As shown in FIG. 8, each hook 810 extends from the inward-facing side 804 of the hose retainer 800. The hook 810 can extend downward, as shown in FIGS. 7 and 8, upward, or can protrude straight outward. With reference to FIGS. 10 and 11, the canister defines corresponding number of hook recesses 812, each sized, shaped, and positioned to receive one of the hooks 810 therein. Each hook recess 812 is defined in part by a hook retaining wall 814 of the canister 120 that engages the hook 810 to inhibit movement of the hook 810 and the hose retainer 800 away from the canister 120.

As shown in FIG. 9, each deflectable tab 820 extends from the inward-facing side 804 of the hose retainer 800, and has a suitably resilient construction such that the tab 820 is capable of deflecting in a lateral direction (indicated by arrow x) in the presence of an applied force, and returning to an initial, undeflected position when the force is removed without undergoing permanent deformation. In the illustrated embodiment, for example, each tab 820 is constructed of a resilient plastic and is connected or secured to the hose retainer 800 only at one end such that an outer end 821 of the tab 820 is free to move or deflect laterally. The outer end 821 of the tab 820 includes a tooth 822 protruding therefrom in the lateral direction x. The tooth 822 can protrude in a laterally inward direction, as shown in FIG. 9, or in a laterally outward direction.

Figure 12:
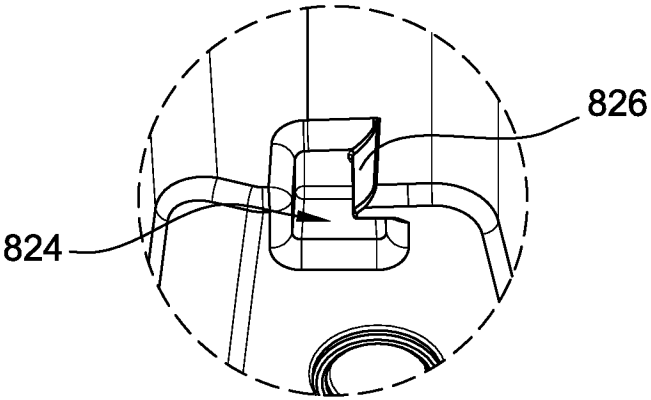
FIG. 12 is an enlarged view of another portion of the vacuum cleaner shown in FIG. 10.

With additional reference to FIG. 12, the canister 120 defines a corresponding number of tab recesses 824, each sized, shaped, and positioned to receive one of the tabs 820 therein. Each tab recess 824 is defined in part by a tab retaining wall 826 that engages the tooth 822 to inhibit movement of the tab 820 and the hose retainer 800 away from the canister 120.

Referring again to FIG. 7, the hose retainer 800 of the illustrated embodiment also includes an alignment guide 830 disposed on an upper portion of the inward-facing side 804 of the hose retainer 800. The alignment guide 830 cooperates with the powerhead 200 to facilitate alignment and attachment of the powerhead 200 to the canister 120, for example, after debris is emptied from the canister 120. The powerhead housing 300 includes a corresponding alignment slot 832 (FIG. 10) that is shaped, sized, and positioned to receive the alignment guide 830 therein. In use, as the powerhead 200 is lowered or moved towards the canister 120 (e.g., after the powerhead 200 is removed to empty the debris canister 120), the alignment guide 830 engages the powerhead 200 within the alignment slot 832, and aligns the powerhead 200 with the canister 120 to facilitate reconnecting the powerhead 200 to the canister 120. Additionally, the alignment guide 830 can be used to facilitate alignment of the hose retainer 800 with the canister 120 when connecting the hose retainer 800 to the canister 120. For example, disposing the alignment guide 830 within the alignment slot 832 aligns the hose retainer 800 with the canister 120 and powerhead 200 such that the fasteners 806 of the hose retainer 800 can be received within the corresponding recesses defined in the canister 120. The alignment guide 830 of the illustrated embodiment does not inhibit movement of the powerhead 200 in a vertical direction or directly away from the canister 120. As such, the powerhead 200 is removable from the canister without disconnecting the hose retainer 800 from the canister 120.

Figure 14:
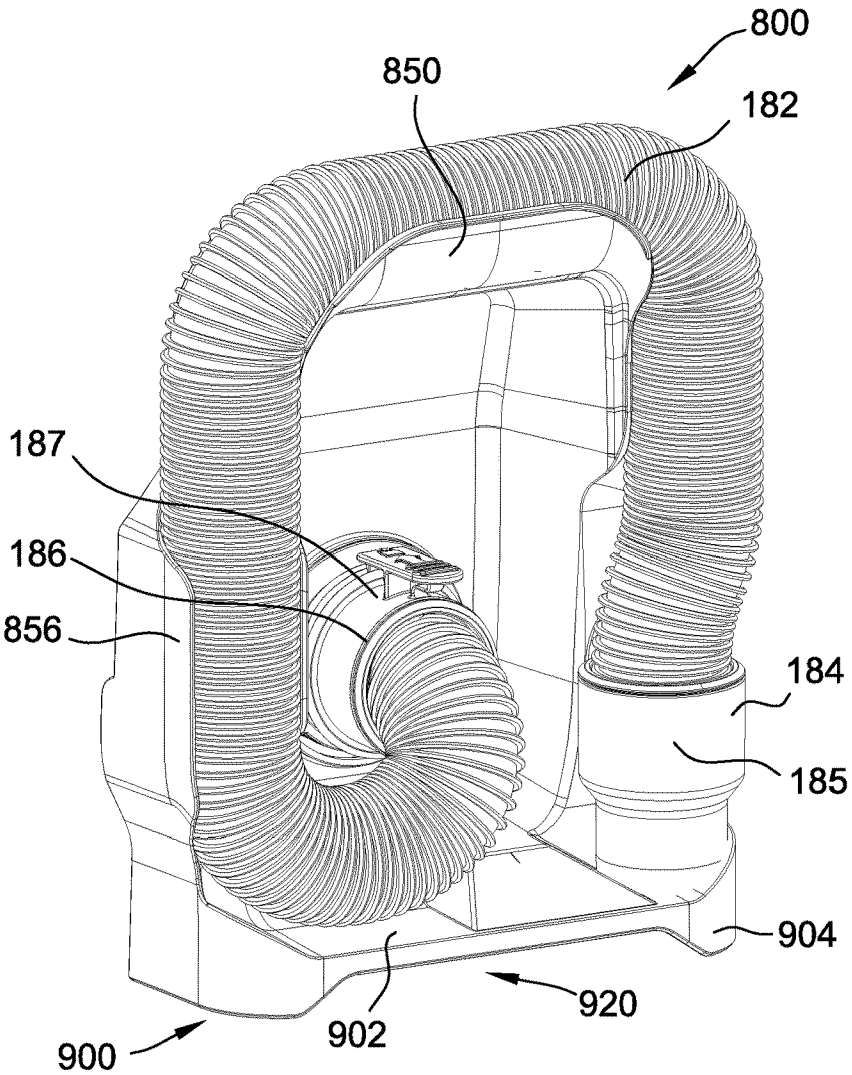
FIG. 14 is a perspective view of the hose retainer shown in FIG. 1 including the vacuum conduit.
Figure 13:
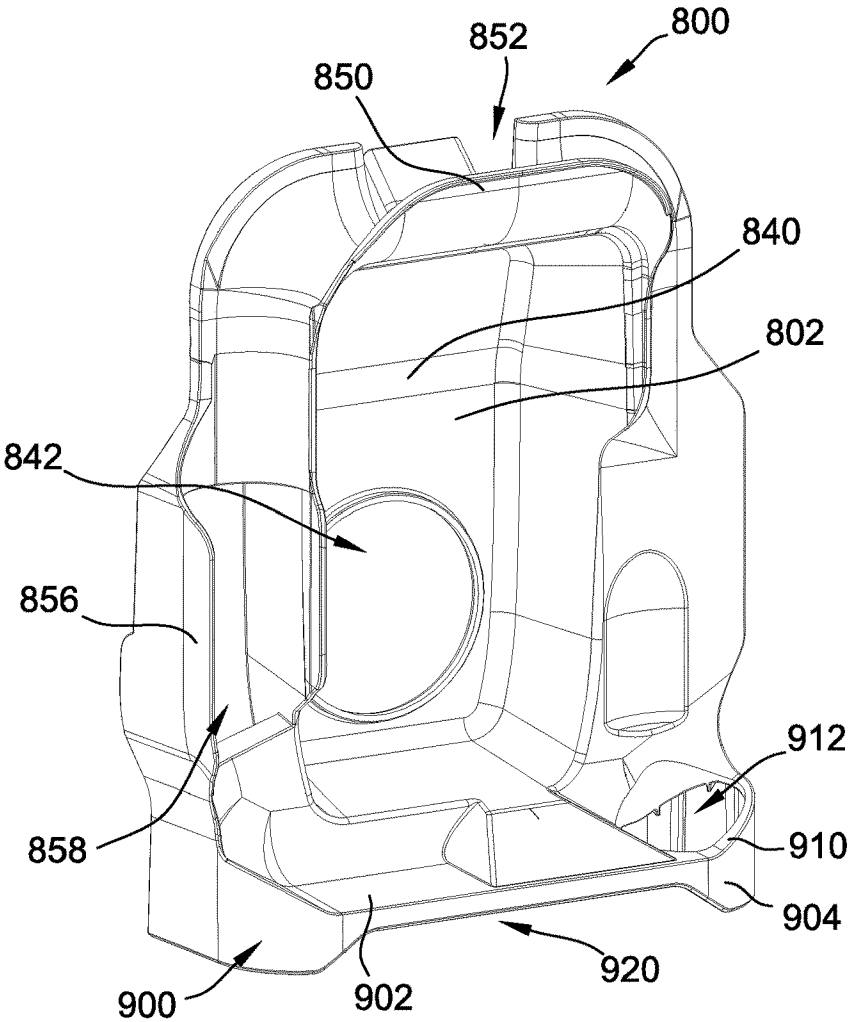
FIG. 13 is a perspective view of an outward-facing side of the hose retainer of the vacuum cleaner shown in FIG. 1.

With additional reference to FIGS. 13 and 14, the hose retainer 800 includes a back plate 840 defining an aperture 842 therethrough. When the hose retainer 800 is connected to the canister 120, as shown in FIG. 6, the inlet port 130 extends through the aperture 842, and the outlet end 186 of the hose 182 is connectable to inlet port 130. The aperture 842 shown in the illustrated embodiment is circular, but may have any other suitable shape such that the inlet port 130 can extend therethrough, including, for example and without limitation, elliptical, rectangular, or square.

Figure 16:
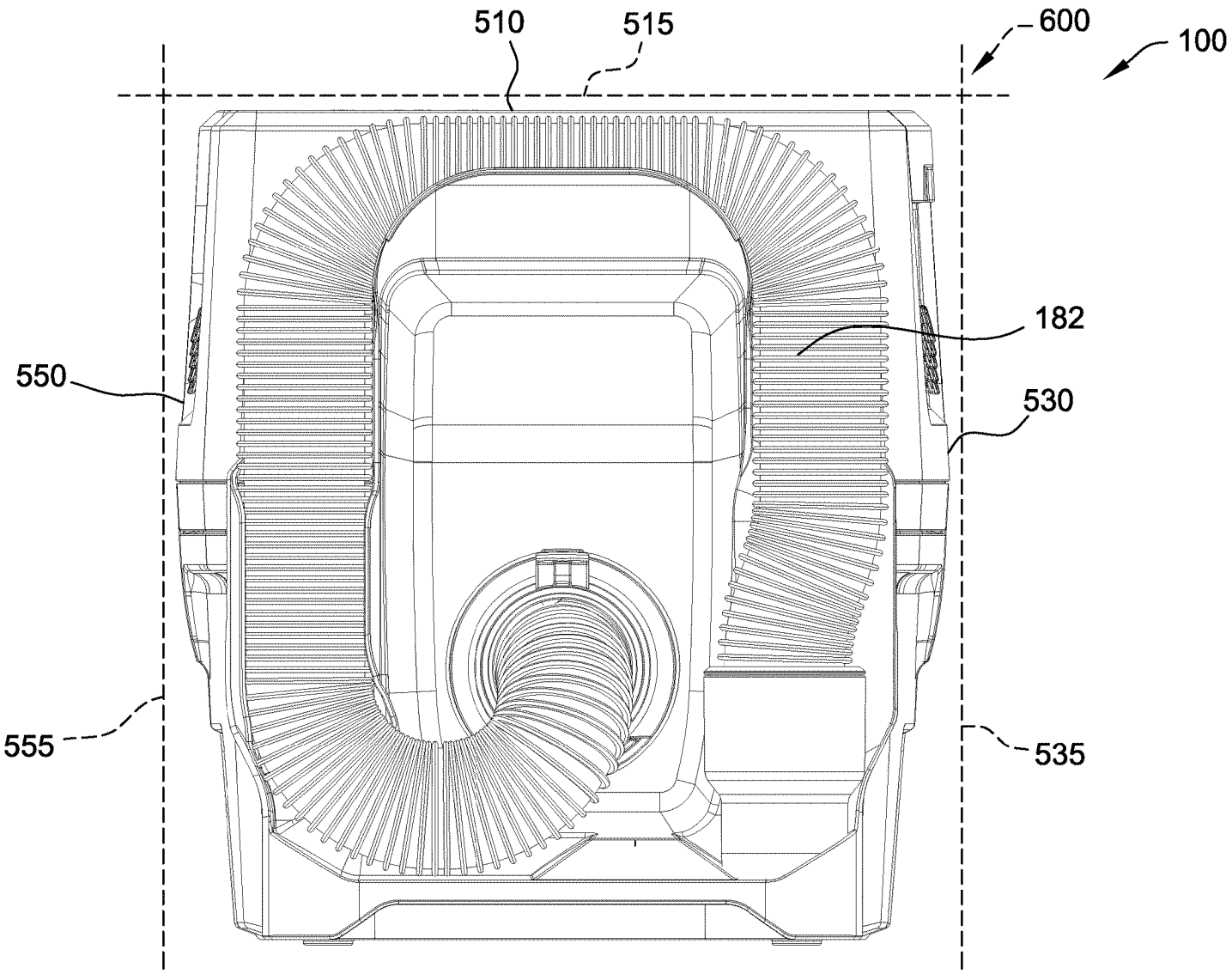
FIG. 16 is a side view of the vacuum cleaner shown in FIG. 1 illustrating a side profile of the vacuum cleaner.

The hose retainer 800 includes one or more hose retention clips 850, 856, each defining a channel sized and shaped to receive a portion of the hose 182 therein. Each hose retention clip engages a portion of a circumferential surface of the hose 182 to retain the hose 182 by an interference fit, clearance fit, or any other suitable means. In the illustrated embodiment, the hose retainer 800 includes a first hose retention clip 850 defining a first channel 852 oriented substantially parallel to the top plane 515, and a second hose retention clip 856 defining a second channel 858 oriented substantially parallel to the front and rear planes 535, 555. The first and second channels 852, 858 are oriented perpendicular to one another in the illustrated embodiment. Other embodiments may include a different number of hose retention clips, such as one, three, or more, configured in any orientation that allows the hose retainer 800 to function as described herein. With reference to FIG. 16, when the hose 182 is mounted in the hose retainer 800 (e.g., in both hose retention clips 850, 856), the hose 182 does not extend beyond the side profile 600 of the vacuum cleaner 100 described above. That is, the hose 182 does not extend beyond the top plane 515, the front plane 535, or the rear plane 555 because the hose retainer 800 constrains the hose 182 within the outer bounds of the vacuum cleaner 100 when viewed from the side.

Referring again to FIGS. 13 and 14, the hose retainer 800 also includes a dustpan 900, integrally formed on a lower portion of the hose retainer 800 in the example embodiment. The dustpan 900 is configured to facilitate collection of debris by providing an area where a user can sweep or otherwise move debris that is entrained within the airflow generated by the vacuum cleaner 100, and thereby collected within the debris canister 120. In the illustrated embodiment, the dustpan 900 includes a hose end mount 910 defining a hose end opening 912. The hose end opening 912 is sized and shaped to receive the inlet adapter 185 to removably connect the inlet end 184 of the hose 182 to the hose end mount 910. The inlet end 184 of the hose 182 can be inserted therein either for storage purposes or to use the dustpan 900 when the vacuum cleaner 100 is in operation. The hose end mount 910 can retain the inlet end 184 of the hose 182 by an interference fit, clearance fit, interlocking features, or by any other suitable means.

Figure 15:
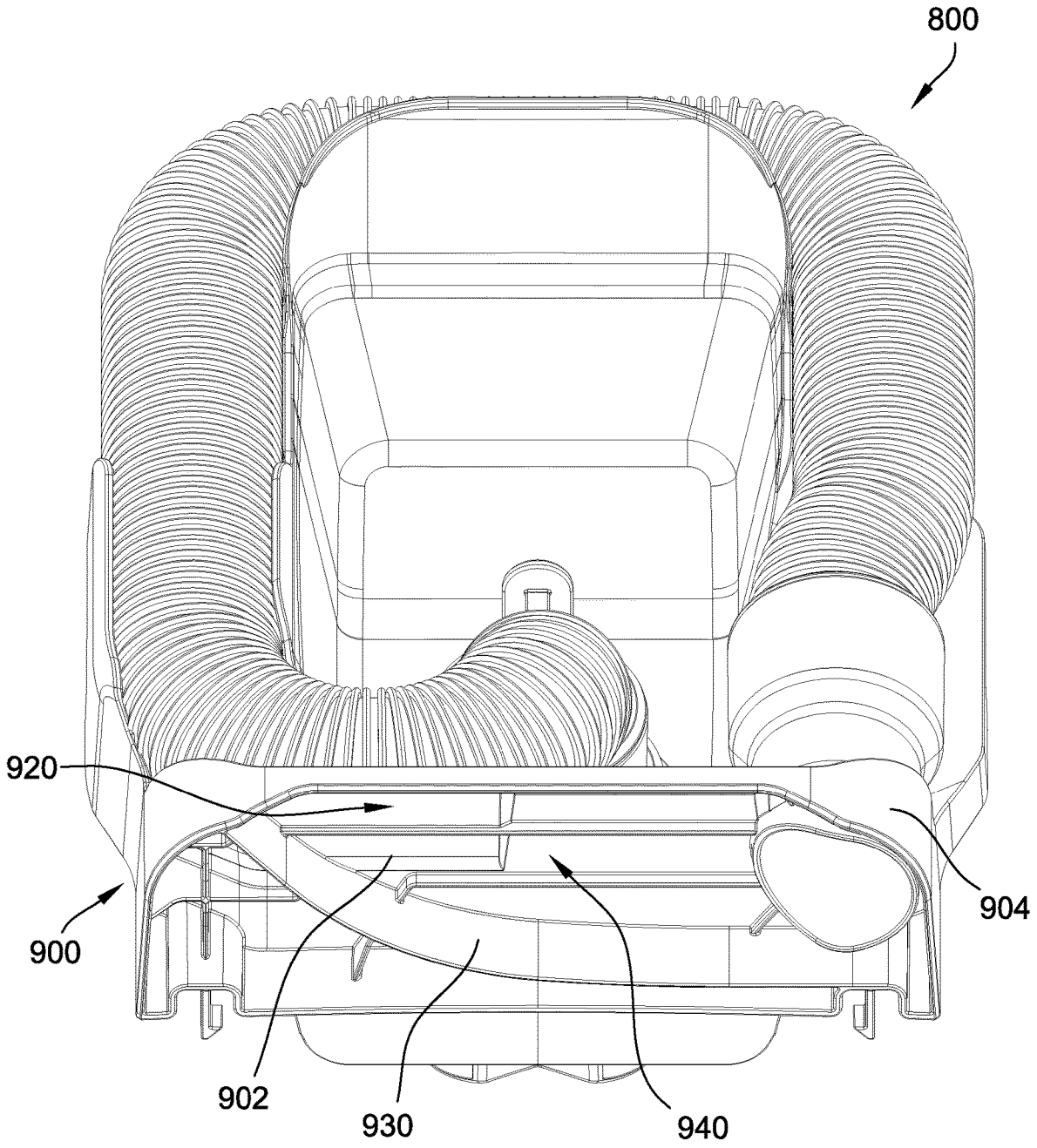
FIG. 15 is a bottom perspective view of the hose retainer and vacuum conduit shown in FIG. 14.

The dustpan 900 also defines a debris intake opening 920, shown in FIG. 15. When the inlet end 184 of the hose 182 is connected to the hose end mount 910, the debris intake opening 920 is in fluid communication with the inlet end 184 of the hose 182 and becomes part of the flow path described above. In such configurations, operation of the suction unit 210 creates a suction force at the debris intake opening 920, drawing airflow and debris into the flow path therefrom. The user can thus sweep debris near or through the debris intake opening 920 to be drawn into the dustpan 900 by the suction force of the suction unit 210.

In the illustrated embodiment, the dustpan 900 includes a bottom wall 902 of the hose retainer 800 that extends or protrudes from the back plate 840, and a skirt 904 that depends from the bottom wall 902. The skirt 904 extends around the bottom wall 902 from one side of the back plate 840 to the other, and is notched along a front of the hose retainer 800 to define the intake opening 920. The dustpan 900 also includes an arcuate baffle 930 depending from the bottom wall 902 to guide debris from the debris intake opening 920 towards the inlet end 184 of the hose 182 when connected to the hose end mount 910. The bottom wall 902, skirt 904, and arcuate baffle 930 cooperatively define a plenum or cavity 940 within the dustpan 900 that receives debris through the intake opening 920. The hose end opening 912 is defined by the bottom wall 902, and extends through the bottom wall 902 into communication with the cavity 940.

In the illustrated embodiment, the dustpan 900 has an open bottom such that the cavity 940 is partially defined by a surface on which the vacuum cleaner 100 sits (e.g., the ground). Operation of the suction unit 210 creates a suction force within the cavity 940, drawing air and debris into the cavity 940 from the intake opening 920 and through the hose end opening 912 from the cavity 940. The user can thus move the vacuum cleaner 100 from one location to the next, situating the dustpan above any debris to generate a suction force within the cavity 940 that draws the debris into the flow path.

The hose retainer 800 of the illustrated embodiment is constructed as a single, unitary piece. For example, the hose retainer 800 can be formed as a single piece of injection molded plastic. In other embodiments, the hose retainer 800 can be assembled from separate pieces, such as two, three, or more separate pieces.

An example method of assembling the vacuum cleaner 100 includes connecting the hose retainer 800 to the sidewall 124 of the canister 120, connecting the powerhead 200 to the top 121 of the canister 120, connecting the inlet end 184 of the hose 182 to the dustpan 900, connecting the outlet end 186 of the hose 182 to the inlet port 130, and disposing a portion of the hose 182 within at least one hose retention clip of the hose retainer 800. Connecting the hose retainer 800 to the canister 120 can include connecting one of the fasteners 806 of the hose retainer 800 to the canister 120, for example, by inserting the fastener into a corresponding fastener recess defined by the canister 120.

Embodiments of the vacuum cleaners described herein provide several advantages over prior designs. For example, the hose retainer enables the hose to be stored compactly and within the profile of the vacuum cleaner, reducing its footprint and the amount of storage space it requires. The hose retainer also provides structure for the vacuum cleaner to be used in multiple configurations. For example, the vacuum cleaner can be operated without removing the hose from the hose retainer. In such cases, the user can sweep debris into the dustpan to be picked up. Alternatively, and because the dustpan has an open bottom, the user can move the entire vacuum cleaner to situate the dustpan over debris to be picked up. The user can also remove the inlet end of the hose from the hose retainer to use it manually, and can attach various vacuum accessories to more effectively clean different surfaces or hard-to-reach areas. Additionally, the powerhead can be removed from canister to empty the debris chamber without having to remove the hose or hose retainer from the vacuum cleaner 100.

As used herein, the terms "about," "substantially," "essentially" and "approximately" when used in conjunction with ranges of dimensions, concentrations, temperatures or other physical or chemical properties or characteristics is meant to cover variations that may exist in the upper and/or lower limits of the ranges of the properties or characteristics, including, for example, variations resulting from rounding, measurement methodology or other statistical variation.

When introducing elements of the present disclosure or the embodiment(s) thereof, the articles "a," "an," "the," and "said" are intended to mean that there are one or more of the elements. The terms "comprising," "including," "containing," and "having" are intended to be inclusive and mean that there may be additional elements other than the listed elements. The use of terms indicating a particular orientation (e.g., "top," "bottom," "side," etc.) is for convenience of description and does not require any particular orientation of the item described.

As various changes could be made in the above constructions and methods without departing from the scope of the disclosure, it is intended that all matter contained in the above description and shown in the accompanying drawing [s] shall be interpreted as illustrative and not in a limiting sense.

What is claimed is:

1. A vacuum cleaner comprising:

a canister defining a debris chamber and including a base and at least one sidewall extending from the base, the at least one sidewall including an inlet port;

a powerhead connected to a top of the canister and including a suction unit operable to generate airflow through the canister;

a hose having a first, inlet end and a second, outlet end removably connectable to the inlet port; and a hose retainer removably connected to the canister, the hose retainer comprising:

a back plate defining an aperture therethrough, wherein the inlet port extends through the aperture;

at least one hose retention clip defining a channel sized and shaped to receive a portion of the hose therein; and a dustpan defining a debris intake opening and including a hose end mount removably connectable to the inlet end of the hose, wherein the inlet end of the hose is in fluid communication with the debris intake opening when connected to the hose end mount to generate airflow through the debris intake opening.

2. The vacuum cleaner of claim 1, wherein the hose retainer comprises a first hose retention clip defining a first channel and a second hose retention clip defining a second channel, wherein the first and second channels are oriented perpendicular to one another.

3. The vacuum cleaner of claim 1, wherein the vacuum cleaner has a side profile when viewed from one of a first side or an opposing second side, the side profile defined by a top surface, a front surface, and a rear surface of the vacuum cleaner, wherein the hose does not extend beyond the side profile of the vacuum cleaner when mounted in the hose retainer.

4. The vacuum cleaner of claim 3, wherein the side profile is rectangular.

5. The vacuum cleaner of claim 1, wherein the hose retainer further comprises at least one fastener for removably connecting the hose retainer to the canister.

6. The vacuum cleaner of claim 5, wherein the at least one fastener comprises a hook, and wherein the canister defines at least one hook recess sized and shaped to receive and retain the hook therein.

7. The vacuum cleaner of claim 5, wherein the at least one fastener comprises a deflectable tab, and wherein the canister defines at least one tab recess sized and shaped to receive and retain the tab therein.

8. The vacuum cleaner of claim 7, wherein the deflectable tab comprises a tooth, wherein the at least one tab recess is defined in part by a retaining wall, and wherein the retaining wall engages the tooth of the deflectable tab to inhibit movement of the hose retainer.

9. The vacuum cleaner of claim 1, wherein the hose retainer further comprises an alignment guide, and wherein the powerhead defines an alignment slot shaped and sized to receive the alignment guide therein.

10. The vacuum cleaner of claim 1, wherein the dustpan comprises an arcuate baffle that guides debris from the debris intake opening towards the inlet end of the hose when connected to the hose end mount.

11. The vacuum cleaner of claim 1, wherein the dustpan has an open bottom.

12. The vacuum cleaner of claim 1, wherein the hose retainer is constructed as a single, unitary piece.

13. The vacuum cleaner of claim 1, wherein the powerhead defines at least one storage recess sized and shaped to receive a vacuum accessory.

14. The vacuum cleaner of claim 1, wherein the powerhead is removable from the canister without disconnecting the hose retainer from the canister.

15. A hose retainer for a vacuum cleaner, the hose retainer comprising:

a back plate defining an aperture therethrough;

at least one hose retention clip defining a channel sized and shaped to receive a portion of a vacuum hose therein; and a dustpan defining a debris intake opening and including a hose end mount, the hose end mount defining an opening sized and shaped to receive an end of the hose therein, wherein the hose retainer is constructed as a single, unitary piece.

16. The hose retainer of claim 15, further comprising at least one fastener for removably connecting the hose retainer to a vacuum canister.

17. The hose retainer of claim 16, wherein the at least one fastener comprises:

a hook sized and shaped to be received in a hook recess of the vacuum canister; and a deflectable tab sized and shaped to be received in a tab recess of the vacuum canister.

18. A method of assembling a vacuum cleaner including a canister, a powerhead, a hose, and a hose retainer, the method comprising:

connecting the hose retainer to a sidewall of the canister, wherein the canister includes an inlet port, wherein the hose retainer includes a dustpan, at least one hose retention clip, and a backplate defining an aperture therethrough, and wherein the inlet port extends through the aperture; connecting the powerhead to a top of the canister; connecting an inlet end of the hose to the dustpan of the hose retainer; connecting an outlet end of the hose to the inlet port of the canister; and disposing a portion of the hose between the inlet and outlet ends within the at least one hose retention clip of the hose retainer.

19. The method of claim 18, wherein the hose retainer includes at least one fastener disposed thereon, wherein the canister defines at least one fastener recess sized and shaped to receive and retain the at least one fastener therein, wherein connecting the hose retainer to the canister further comprises disposing the at least one fastener within the at least one fastener recess.

* * * * *